US005186275A

United States Patent [19]

Bajin

[11] Patent Number: 5,186,275

[45] Date of Patent: Feb. 16, 1993

[54] HIGHRISE FAMILY FIRE ESCAPE DEVICE

[76] Inventor: Zivojin Bajin, 353 Northcliffe Blvd., Toronto, Ontario, Canada, M6E 3K9

[21] Appl. No.: 886,212

[22] Filed: May 21, 1992

Related U.S. Application Data

[63] Continuation-in-part of Ser. No. 600,737, Oct. 22, 1990, abandoned.

[51] Int. Cl.[5] ..... A62B 1/00; A62B 35/00

[52] U.S. Cl. ..... 182/5; 182/231; 182/236

[58] Field of Search ..... 182/231, 5–7, 182/236, 191, 192, 193

[56] References Cited

U.S. PATENT DOCUMENTS

| | | | |
|---|---|---|---|
| 192,548 | 6/1877 | Warth | 182/7 |
| 518,920 | 4/1894 | Harvey | 182/7 |
| 705,580 | 7/1902 | Hammerly | 182/193 |
| 1,128,025 | 2/1915 | Mass | 182/193 |
| 1,351,734 | 9/1920 | Barrington | 182/5 |
| 2,432,741 | 12/1947 | Frankel | 182/6 |
| 4,093,186 | 6/1978 | Golden | 182/191 X |
| 4,550,801 | 11/1985 | Forrest | 182/7 |
| 4,598,793 | 7/1986 | Lew et al. | 182/5 X |
| 4,640,388 | 2/1987 | Walborn | 182/231 |

*Primary Examiner*—Karen J. Chotkowski
*Attorney, Agent, or Firm*—Bereskin & Parr

[57] ABSTRACT

A fire escape device enabling persons to be lowered from tall structures. The device features a cable spool about which a cable is wound for at least one revolution. A helical channel is defined on the outer surface of the cable spool for the cable to ride in and a spool casing is provided to prevent the cable from riding out of the channel. A housing having first and second ends supports the cable spool and spool casing. Housing openings and channel openings are provided to allow the cable to pass into the channel about the spool. Harness supports are also provided at the first and second ends of the housing to hold the harness straps. A person is secured in the harness straps and may be lowered from the structure at a controlled rate by passing the cable through the housing. It is possible for the person to control their own rate of descent although it could also be controlled by a person in the structure or a person on the ground.

7 Claims, 5 Drawing Sheets

HIGHRISE FAMILY FIRE ESCAPE DEVICE

CONTINUATION-IN-PART

This is a continuation-in-part of the Applicant's original application filed Oct. 22, 1990, bearing Ser. No. 07/600,737 and now abandoned.

FIELD OF THE INVENTION

The present invention relates to the field of fire escape devices and in particular, to a fire escape device that permits a person to lower themselves, or be lowered, in a balanced position by means of a cable extending from a tall structure.

BACKGROUND OF THE INVENTION

A variety of fire escape devices are known. Many of these devices utilize a rope that is wound about a pulley mechanism. The pulley mechanism provides a resistive force so that the rate of descent of the passenger may be controlled by hand.

Examples of such devices may be seen in the following U.S. Pat. Nos.: 1,128,025 (Mass); 1,351,734 (Barrington); 2,432,741 (Frankel); and 4,550,801 (Forrest).

Most of the devices described in the above patents are quite cumbersome and thus are not practical as devices that may be inconspicuously stored and easily retrieved in case of an emergency. It is desirable that a fire escape device be less cumbersome so that it is not considered an eyesore or an obstruction in the home. There is also a tendency in the above devices for the rope to wrap onto itself and tangle or bind so that the passenger may become stuck before reaching a point of safety. Finally, the above devices provide little to ensure that the passenger is balanced in a generally upright position when they are being lowered. Since the rope is typically only attached at the point of descent, it will tend to be unsteady and sway when a person is being lowered along it. Consequently, it is highly desirable that the passenger be comfortably balanced when they are being lowered so that their descent is not hindered by their disorientation. If the passenger is responsible for regulating their own rate of descent, it is imperative that they be in a comfortable balanced position.

Some of the above problems have been addressed to a certain extent by U.S. Pat. Nos. 518,920 (Harvey) and 4,598,793 (Lew et al.), which provide escape devices featuring grooves in the pulley mechanism for accommodating the rope. The grooves guide the rope about the pulley and thus reduce the chances of the rope becoming tangled or binding.

The Lew at al. patent provides a cumbersome device however which is impractical to store or set up. The Harvey patent, on the other hand, provides a relatively portable unit. In this device, the pulley is further enclosed by a cylindrical body having apertures aligned in a vertical position allowing the rope to be fed through the pulley. The Harvey device does not provide adequate balancing means however, and indeed the device appears to have a tendency to pivot under the weight of the passenger being lowered. The pivoting of the device could place the passenger in a precarious position dangling from the harness. Furthermore, the apertures would likely no longer be vertically aligned and the rope may not feed properly through the pulley means. Thus the descent of the passenger may be severely retarded or even stopped. Finally, the cylindrical body is not so spaced from the pulley as to ensure that the rope will not ride out of its groove and become tangled upon itself.

It is desirable to provide an improved fire escape device that addresses the problems faced by the above prior art devices. The device should be reasonably portable so that it may be stored in a place near an escape route, such as a window. It should provide means to reduce the chances of the rope becoming tangled or binding. Finally the device should ensure that the passenger is comfortable and balanced when descending along the rope.

SUMMARY OF THE INVENTION

The present invention provides a fire escape device for enabling persons to be lowered from tall structures. The fire escape device comprises a cable spool having an outer surface defining a helical channel extending for at least one revolution about the spool, and a spool casing having an inner surface surrounding the outer surface of the cable spool. The spool casing defines first and second channel openings permitting access to each end respectively of the helical channel from the exterior of the spool casing. A housing is provided having first and second ends, the cable spool and spool casing being secured adjacent the first end. The housing defines housing openings permitting access to the channel openings. A cable is passed through the housing openings and channel openings such that the cable passes at least once about the spool along the helical channel and extends from each end of the housing openings. Attachment means are located at at least one end of the cable. First and second harness supports are provided where the first support is attached to the housing adjacent to the axis of the spool, and the second support is attached adjacent to the second end of the housing. Finally, first and second harness straps are provided attachable respectively to the first and second harness supports. A person may be secured into the first and second harness straps attached to the first and second harness supports and lowered from the structure at a controlled rate by passing the cable through the housing.

BRIEF DESCRIPTION OF THE DRAWINGS

For a better understanding of the present invention, and to show more clearly how it may be carried into effect, reference will now be made, by way of example, to the accompanying drawings, which show a preferred embodiment of the present invention, and in which.

DETAILED DESCRIPTION OF THE PREFERRED EMBODIMENT

Figure 1:
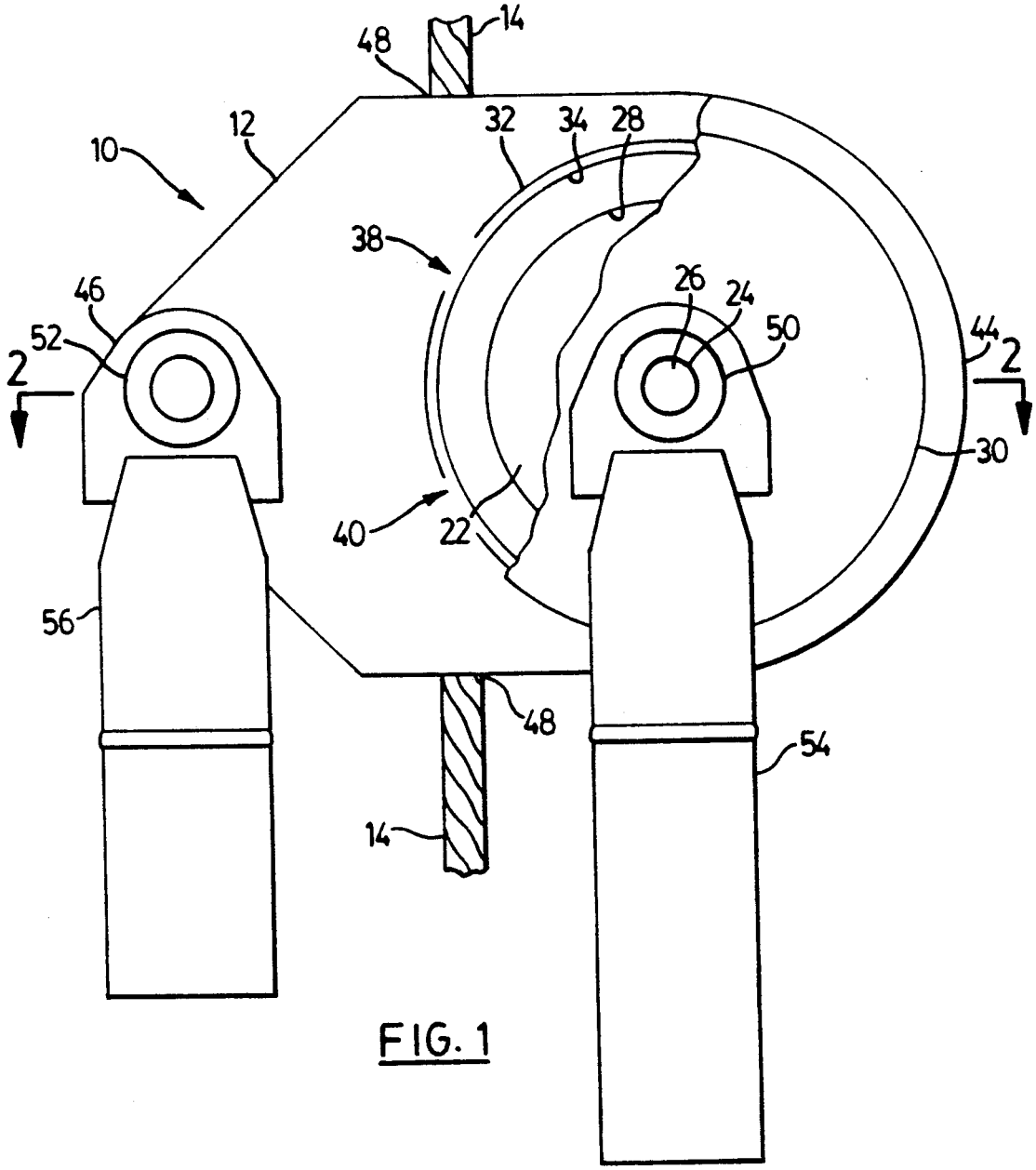
FIG. 1 is a front view in partial section of the housing of a fire escape device in accordance with the present invention.

A fire escape device as claimed in the present invention is shown generally at 10 in FIG. 1. The drawing is directed to show the housing 12 and thus portions of the cable 14 and the first and second harness straps 54, 56 are not completely shown. The harness straps 54, 56 and the entire cable 14 including attachment means 58 may be more clearly seen in FIGS. 6–9.

The escape device 10 includes a non-rotating cable spool 22 that supports at least one revolution of the cable 14. Preferably the cable is constructed of a strong, slender material such as steel aircraft cable although other materials such as nylon may be used. The cable is preferably slender so that great lengths of it may be stored in a relatively small area. Of course, the cable 14 must be of a sufficient length that it may reach the ground from the departure point. It is found that two revolutions of the cable 14 about the spool 22, as may be seen in FIG. 2, is sufficient to provide an adequate resistive force to control the rate of descent of a person being lowered by the device.

In order to reduce the chances of the cable 14 becoming tangled or binding, a helical channel 36 is provided. The helical channel 36 is defined along the outer surface 28 of the spool 22 and may be integral with the spool 22 or may be attached as a separate element to the outer surface 28.

The helical channel 36 preferably has a semi-circular cross-section. The radius of the semi-circular cross-section is generally equal to but not less than the radius of the cable 14.

Figure 2:
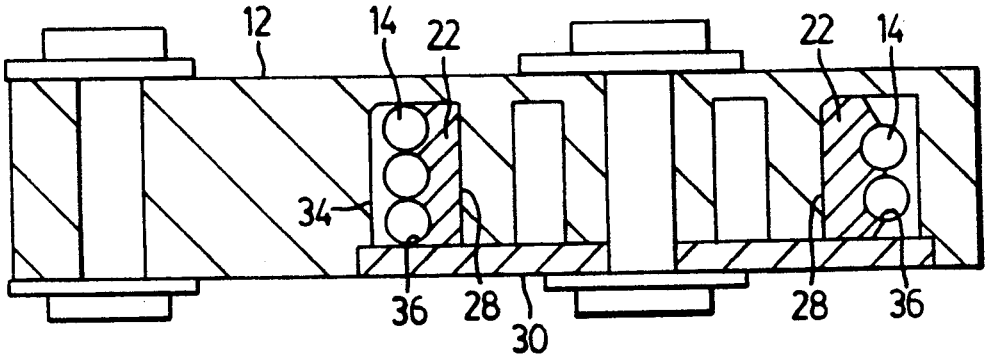
FIG. 2 is a sectional view of the housing of a fire escape device in accordance with the present invention as taken along lines 2—2 in FIG. 1.

The channel 36 defines the path for the cable 14 and thus preferably helically encircles the spool 22 for two complete revolutions as may be seen in FIG. 2. Since FIG. 2 is a sectional view, the channel 36 is shown supporting what appear to be three sections of cable 14 at one edge of the spool 22 and what appear to be two sections of cable 14 on the other edge of the spool. This reflects the spiral nature of the channel 36 and the fact that the channel begins and ends at the same axial point along the circumference of the spool 22.

To ensure that the cable 14 follows the channel 36 and does not ride up over the edges of the channel 36, a spool casing 32 having an inner surface 34 is provided. The spool casing 32 surrounds the outer surface 28 of the cable spool 22 to cover the helical channel 36. Preferably the inner surface 34 of the spool casing 32 is spaced from the outer surface 28 of the spool 22 sufficiently to prevent the cable 14 from riding out of the helical channel 36. Thus, when the cable 14 is in the helical channel 36, the inner surface 34 of the spool casing 32 is preferably spaced a distance less than the radius of the cable 14 from the outer surface 28 of the spool 22. In this manner, the cable 14 will not have sufficient space to ride out of the helical channel 36.

As a result, there is provided a generally enclosed helical channel 36 that ensures that the cable 14 does not tangle or bind on itself when carried by the spool 22.

The spool casing 32 has first and second channel openings 38, 40 for permitting the cable 14 to pass to the channel 36 from the exterior of the spool casing 32.

The spool and spool casing are supported by the housing 14. The spool 22 is arranged such that its axis is generally perpendicular to the line of gravitational force acting upon the housing 12. Although the spool 22 may conceivably be integral with the housing 12, preferably the spool 22 is a separate element mounted in an annular recess 26 located on the housing 12. The spool and spool casing are located at a first end 44 of the housing 12. The second end 46 of the housing 12 is located such that the housing 12 straddles the cable 14 as is further described below. A cover 30 may be provided as seen in FIGS. 1 and 2 to allow access to said spool and spool casing.

Housing openings 48 are provided to allow the cable 14 to pass through to the first and second channel openings 38, 40. Preferably, the housing openings 48 and the first and second channel openings 38, 40 are aligned along a common axis as depicted in FIG. 1. This alignment generally follows the line of gravitational force acting upon the housing.

Preferably the helical channel 36 is constructed from a strong, resilient material such as brass. This material is less likely to wear under the frictional strain exhibited by the cable 14. The housing 14 is preferably constructed from a strong, light-weight material such as aluminum. This allows the device 10 to be less cumbersome and easier to lift or carry.

First and second harness supports 50, 52 are attached to the housing 12. The first harness support 50 is preferably attached by a bolt 24 that is coaxial with the cable spool at the first end 44 of the housing 12. The second harness support 52 is attached adjacent the second end of the housing 46. The first harness support 50 is preferably spaced from the second harness support 52 a distance generally equal to the diameter of the cable spool 22. This ensures that the first and second harness supports 50, 52 are balanced on the housing 12 relative to the cable 14. The cable 14 should be equally spaced from the first and second harness supports 50, 52 when the cable 14 passes through the housing openings 48 and the channel openings 38, 40.

Figure 3:
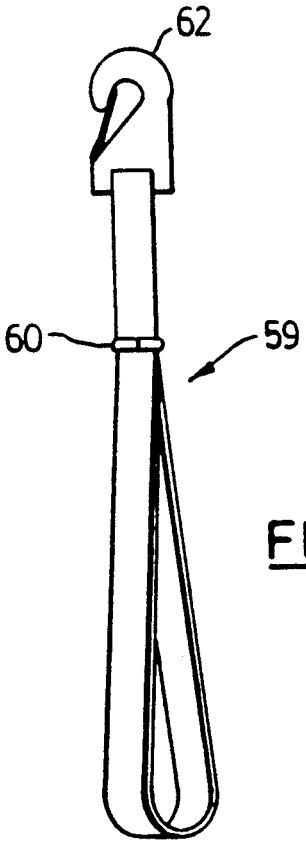
FIG. 3 is a perspective view of an adjustable harness strap in accordance with the present invention.
Figure 9:
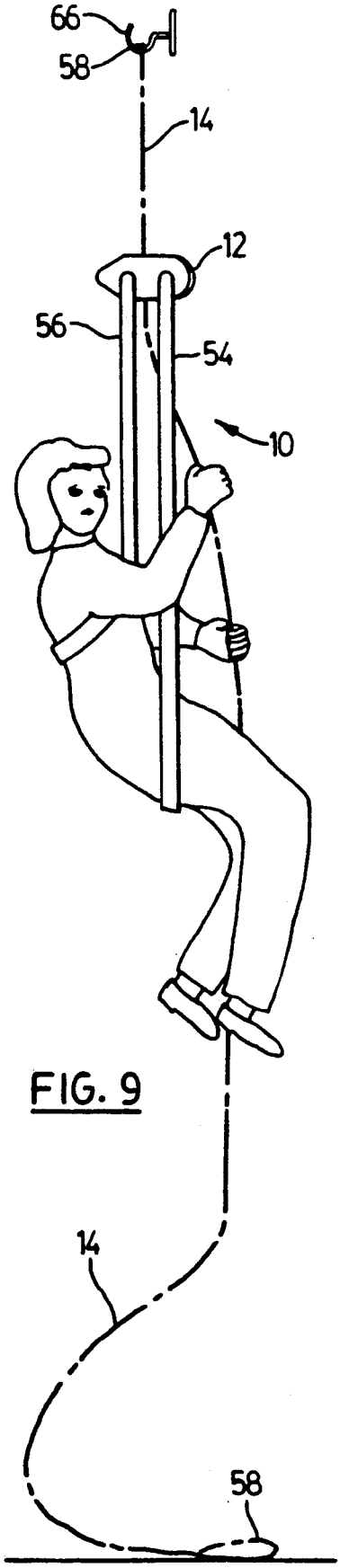
FIG. 9 is a perspective view of a fire escape device in accordance with the present invention depicting a person resting in a balanced position in the harness straps and lowering herself to the ground.

First and second harness straps 54, 56 are attachable to the first and second harness supports 50, 52. The form and construction of the harness straps 54, 56 are known and preferred embodiments are depicted in FIGS. 3 and 9. In operation as shown in FIG. 9, the first harness strap 54 is placed around the person's buttocks and the second harness strap 56, which is shorter than the first harness strap 54, is placed around the person's back and under their arms. In this arrangement, the person may assume a generally balanced position while lowering themselves along the cable 14. The adjustable harness strap 59 depicted in FIG. 3 features an adjustable sleeve 60 for allowing the strap to be tightened about the person. This is especially useful for unconscious persons or children. In addition, a safety hook 62 may be provided for securing the strap to the harness supports 50, 52 or to attachment means 58 (see escape procedure described below).

Attachment means 58 are provided preferably at each end of the cable 14 in order that the cable 14 may be attached to a fixed object 66 adjacent to the point of departure from the structure. Preferably, the attachment means 58 are in the form of a loop.

Figure 4:
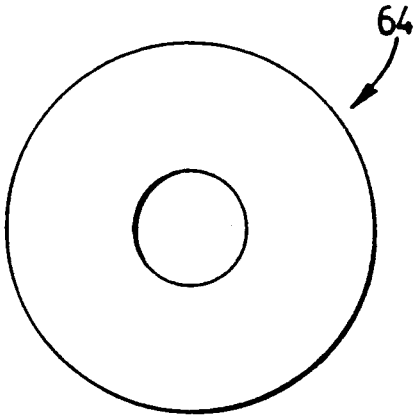
FIG. 4 is a front view of a supplementary spool in accordance with the present invention.
Figure 5:
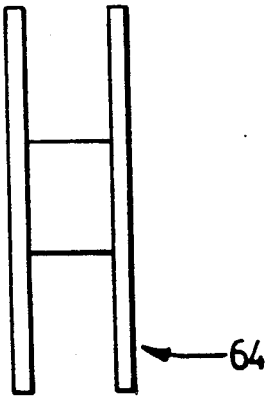
FIG. 5 is a top view of a supplementary spool in accordance with the present invention.

A supplementary spool 64 shown in FIGS. 4 and 5 is provided to store the cable 14 when the device 10 is not in use. The supplementary spool 64 further ensures that the cable 14 may be released to the ground without tangling or knotting. The cable 14 may either be fed from the supplementary spool 64 to the ground or the supplementary spool 64 may itself be dropped to the ground to release the cable 14. In the latter case, it is important that the attachment means 58 at the free end of the cable 14 are secured to the fixed object 66 adjacent to the point of departure from the structure to ensure that the entire cable 14 does not fall to the ground.

When the device 10 is not in use, the cable 14 may be coiled about the supplementary spool 64 and the whole device 10 may be stored at a convenient place on the premises.

ESCAPE PROCEDURE

In the case where a family including children must escape from a tall structure such as a building, the preferred fire escape procedure utilizing the fire escape device 10 is as follows.

The children should be the first to be lowered to safety. Preferably, each child has an adjustable harness strap 59 as depicted in FIG. 3. Each child is instructed to place the strap 59 around their back and under their arms such that the adjustable sleeve 60 and safety hook 62 are located at the front of the child. One or more children may then be secured by means of the safety hook 62 to the attachment means 58 of a free end of the cable 14. It is recommended that the combined weight of the children being lowered to the ground should not exceed 200 lbs.

The first and second harness straps 54, 56 may be attached to the harness supports 50, 52 and the ends of the harness straps may be attached to the fixed object 66 adjacent to the departure point. In this manner, the housing 12 remains fixed adjacent the departure point and the children are lowered by means of the cable 14.

Figure 6:
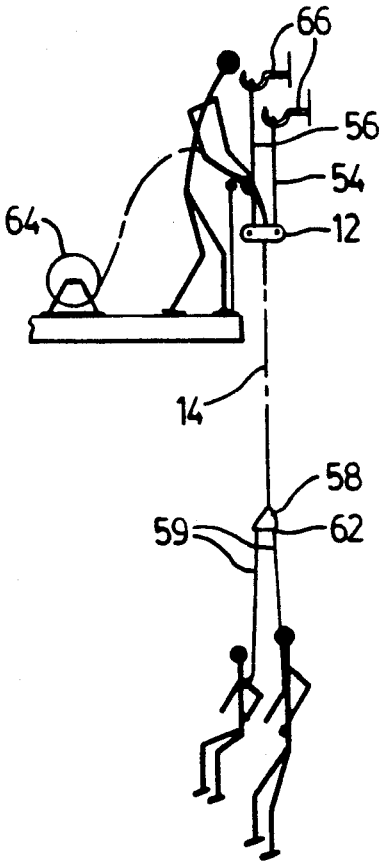
FIG. 6 is a stick figure depiction of a fire escape utilizing a fire escape device in accordance with the present invention where children are being lowered to the ground by an adult controlling the cable from an upper floor.

While an adult takes hold of the cable 14 at a point above the housing 12 relative to the ground, the children may step through the departure point and may subsequently be lowered to the ground. The adult lowers the children to the ground at a controlled rate by loosening his grip on the cable 14 or allowing the cable 14 to slowly slide through his hands as shown in FIG. 6.

Figure 7:
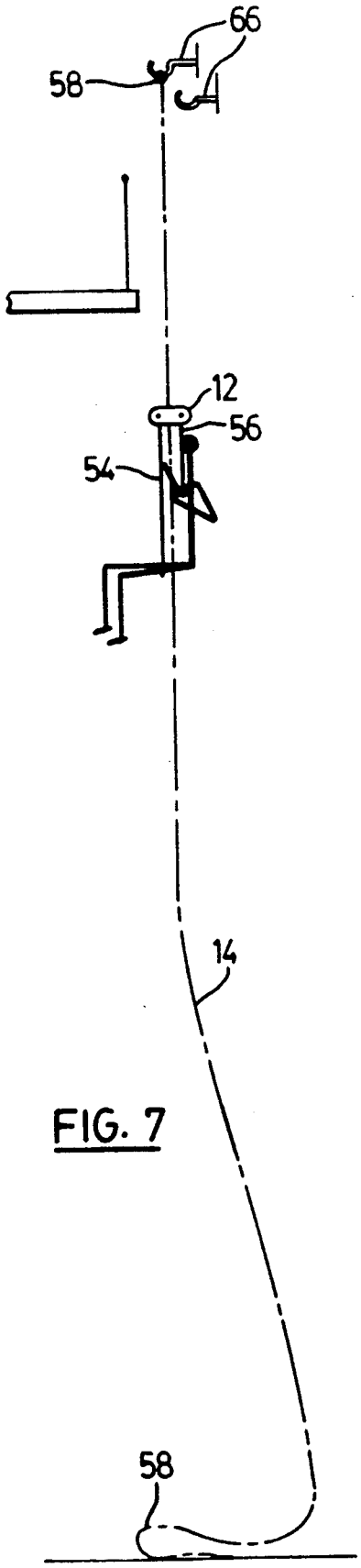
FIG. 7 is a stick figure view of a fire escape utilizing a fire escape device in accordance with the present invention where a person is lowering himself from an upper floor to the ground.

When the children are safely on the ground each safety hook 62 of the adjustable harness strap 59 is removed from the attachment means 58. The adult remaining in the structure removes the supplementary spool and attaches the attachment means 58 at the upper end of the cable 14 to the fixed object 66. The harness straps 54, 56 are removed from their attachment to the fixed object 66 and are fitted to the adult in the appropriate manner. While taking hold of the cable 14 at a point below the housing 12 relative to the ground, the adult steps over the departure point and proceeds to descend towards the ground by loosening his grip on the cable 14 or allowing the cable 14 to slide slowly through his hands as shown in FIG. 7 and FIG. 9.

If further adults remain in the building, the cable may be pulled upwards until the housing and attachment means that were previously at ground level are now in the hands of the adult in the structure. The attachment means 58 nearest the housing 12 are secured to the fixed object 66 and the remainder of the cable 14 is lowered towards the ground. In other words, the housing is inverted and the attachment means 58 reversed so that the device 10 may be placed in a ready position for the next adult to escape. The adult simply follows the same procedure as described above to escape from the structure.

Figure 8:
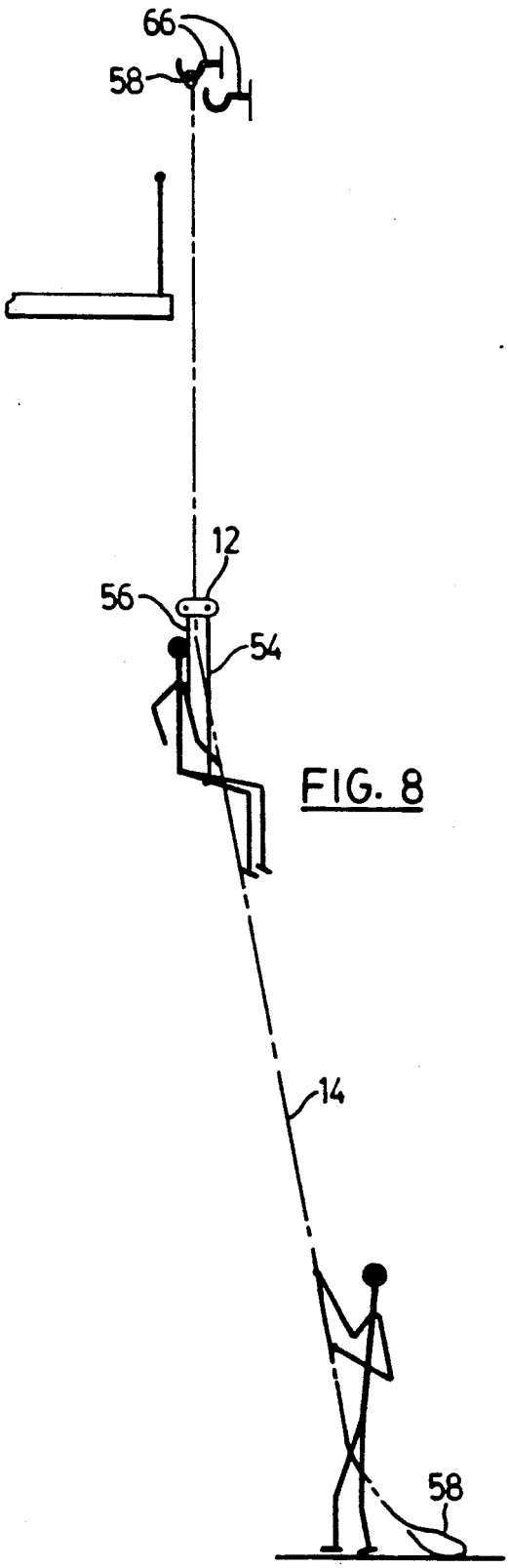
FIG. 8 is a stick figure view of a fire escape utilizing a fire escape device in accordance with the present invention where an injured or elderly person is being lowered from an upper floor to the ground by a person controlling the cable from the ground.

Finally, it is possible that an observer on the ground may take hold of the end of the cable 14 and control the rate of descent of a person descending towards the ground as shown in FIG. 8. This is useful in the case of an injured or elderly person who is not able to grip the cable 14 to control their own rate of descent. The observer on the ground pulls downward on the cable 14 in order to tighten the tension of the cable 14 about the spool 22. By loosening their grip on the cable 14, the observer is able to control the rate of descent of the person escaping from the structure.

It is to be understood that what has been described are preferred embodiments of the invention. The invention nonetheless is susceptible to certain changes and alternative embodiments fully comprehended by the spirit of the invention as described above and the scope of the claims set out below.

I claim:

1. A fire escape device for enabling persons to be lowered from tall structures, said fire escape device comprising:

a cable spool having an outer surface defining a helical channel extending for at least one revolution about said spool;

a spool casing having an inner surface surrounding said outer surface of said cable spool, said spool casing defining first and second channel openings permitting access to said helical channel from the exterior of said spool casing;

a housing having first and second ends, said spool and spool casing being secured adjacent said first end, and said housing defining housing openings between said first and second ends such that said housing openings permit access to said channel openings from the exterior of said housing, said housing openings and said channel openings being generally aligned along a common axis;

a cable passing through said housing openings and channel openings such that said cable passes at least once about said spool along said helical channel and extends from each of said housing openings, said inner surface being spaced from said outer surface sufficiently to prevent said cable from riding out of said helical channel;

attachment means located at at least one end of said cable;

first and second harness supports, said first harness support being attached to said housing adjacent to the axis of said cable spool by a bolt that is coaxial with said cable spool, and said second harness support being attached adjacent to said second end of said housing, whereby said harness supports are located on opposing sides of said cable to provide balanced support to said person being lowered; and first and second harness straps attachable respectively to said first and second harness supports.

2. A fire escape device as claimed in claim 1, wherein said second harness support is spaced from said first harness support by the diameter of said cable spool, whereby, said cable is equally spaced from said first and second harness supports when said cable passes through said housing openings and said channel openings.

3. A fire escape device as claimed in claim 2, wherein at least one of said first and second harness straps has an adjustable sleeve.

4. A fire escape device as claimed in claim 3, wherein said device is invertible such that it may be operated in either direction along said cable.

5. A fire escape device as claimed in claim 4, further comprising a supplementary spool for storing said cable.

6. A fire escape device as claimed in claim 5, further comprising an adjustable harness strap having a safety hook for attaching said adjustable harness strap to said attachment means.

7. A fire escape device as claimed in claim 6, wherein at least one person may be secured into at least one said adjustable harness strap attached by said safety hook to said attachment means and lowered from said structure.

* * * * *